US008241472B2

(12) United States Patent
Altman

(10) Patent No.: US 8,241,472 B2
(45) Date of Patent: Aug. 14, 2012

(54) CLEANING, PICKLING AND ELECTROPLATING APPARATUS

(76) Inventor: Shmuel Altman, Pittsburgh, PA (US)

( * ) Notice: Subject to any disclaimer, the term of this patent is extended or adjusted under 35 U.S.C. 154(b) by 1058 days.

(21) Appl. No.: 12/154,324

(22) Filed: May 22, 2008

(65) Prior Publication Data

US 2009/0200173 A1 Aug. 13, 2009

Related U.S. Application Data

(60) Provisional application No. 61/063,930, filed on Feb. 7, 2008.

(51) Int. Cl.

| | |
|---|---|
| ***C25D 7/06*** | (2006.01) |
| ***C25D 17/00*** | (2006.01) |
| ***C25F 1/00*** | (2006.01) |

(52) U.S. Cl. ..... 204/275.1; 204/269; 205/138; 205/705

(58) Field of Classification Search ..... 204/275.1
See application file for complete search history.

(56) References Cited

U.S. PATENT DOCUMENTS

| | | | | |
|---|---|---|---|---|
| 2,370,973 | A * | 3/1945 | Lang | 72/39 |
| 2,392,687 | A * | 1/1946 | Nachtman | 204/206 |
| 2,445,675 | A | 7/1948 | Lang | |
| 2,803,596 | A | 8/1957 | Brown | |
| 3,654,114 | A * | 4/1972 | Brandstaetter | 204/206 |
| 4,039,398 | A * | 8/1977 | Furuya | 205/145 |
| 4,395,320 | A * | 7/1983 | Kasashima et al. | 204/206 |
| 4,399,018 | A | 8/1983 | Birkle et al. | |
| 4,713,153 | A | 12/1987 | Adriaensen et al. | |
| 5,509,699 | A | 4/1996 | Himmelberger | |
| 6,749,020 | B1 | 6/2004 | Knight | |
| 6,837,973 | B1 * | 1/2005 | Karner | 204/208 |
| 2005/0200129 | A1 * | 9/2005 | Bongiorno | 285/364 |
| 2007/0063517 | A1 * | 3/2007 | Pallini et al. | 285/390 |

FOREIGN PATENT DOCUMENTS

| | | |
|---|---|---|
| EP | 0287070 | 1/1990 |

* cited by examiner

*Primary Examiner* — Harry D Wilkins, III
*Assistant Examiner* — Bryan D. Ripa
(74) *Attorney, Agent, or Firm* — James Ray & Assoc.

(57) ABSTRACT

A continuous electro-cleaning, pickling and electroplating apparatus and method using a plurality of elongate tubes that are electrically conductive.

20 Claims, 6 Drawing Sheets

CLEANING, PICKLING AND ELECTROPLATING APPARATUS

CROSS REFERENCE TO RELATED APPLICATION

This patent application is related to and claims priority from U.S. Provisional Patent Application Ser. No. 61/063,930 filed Feb. 7, 2008.

FIELD OF THE INVENTION

The present invention relates, in general, to electroplating and cleaning and, more particularly, this invention relates to a continuous electroplating and cleaning apparatus.

BACKGROUND OF THE INVENTION

Prior to the conception and development of the present invention, as is generally well known in the prior art, electroplating is typically performed in a batch operation. The same is true of electro-cleaning.

Electroplating requires a prepared surface. In practice, this surface preparation is governed, for example, by ASTM B322. One of the processes used to clean the electroplated surface is electro-cleaning.

The process of electro-cleaning is immerse the piece as an anode in an appropriate solution such as an alkaline salt in an electrolytic cell and to apply a direct current such as described in U.S. Pat. No. 2,803,596 issued to Brown.

A similarly in conventional electroplating the piece is immersed in a suitable solution, such as a metal salt, and attached to the cathode. The anode is either soluble to replace the metal ions depleted from the solution by deposition or insoluble and the solution is replenished. The conventional process requires a current density and extended time to effectively clean and plate the piece.

A continuous process and apparatus is disclosed in U.S. Pat. No. 2,392,687 issued to Nachtman. In this process, a pair of rollers journaled in current conducting bearings contacts the wire. The wire passes through a tubular electrode and a solution is circulated through the apparatus. However, mechanism, including rotating the anode, to apply electrical current to the electrolytic cell is cumbersome and impractical in an industrial setting.

SUMMARY OF THE INVENTION

The present invention provides continuous electro-cleaning, pickling and electroplating apparatus. The apparatus cleans and electroplates round metal pieces, tubes or wire. For convenience and without limiting the intended use, the piece will be referred to as wire. The electro-cleaning and plating portions of the apparatus function separately or in combination.

The electro-cleaning and pickling apparatus provides in the preferred embodiment a plurality of elongate tubes connected together. Each tube is an electrode for the cleaning. A current in the preferred embodiment is applied to the elongate tube that is electrically conductive. In the preferred embodiment, each elongate tube has at least one electrically conductive contact. An appropriate electro-cleaning solution is continuously circulated through a feed tube and removed through a drain tube in each elongate tube. The flow of the solution is controlled by a valve on the feed tube. The wire is centrally located to permit cleaning around the wire as it travels through the bank of elongate tubes. In the preferred embodiment, the tubes have a connecting member that is electrically nonconductive. The connecting member is presently preferably manufactured of plastic. In the presently preferred embodiment, the elongate tubes have a flange generally adjacent to the opposing ends of each tube to be connected. The connecting member receives the elongate tubes, a dowel with threaded apertures, and bolts.

The electroplating portion of the apparatus similarly has electrically conductive elongate tubes. An appropriate solution is continuously circulated through the elongate tubes. However, the elongate tubes are joined with a connecting member that is electrically non conductive. The connecting member is similarly constructed to receive and secure elongate tubes along the longitudinal axis of the apparatus. The connecting member also has cavities to receive electrodes that are in contact with the round wire to be electroplated, a support portion to prevent deflection of the wire to be electroplated and a cavity connected to a drain tube.

The cleaning and electroplating within the elongate tubes allows a uniform cleaning and plating. An additional advantage is that the apparatus allows for the use of a higher current density due to the configuration of the wire and the elongate tubes. The high current density reduces the time for the process.

OBJECTS OF THE INVENTION

It is, therefore, one of the primary objects of the present invention to provide a continuous electro-cleaning, pickling and electroplating apparatus in which the cleaning and plating functions can be used separately or in combination.

Another object of the present invention is to provide a continuous electro-cleaning, pickling and plating method.

Still another object of the present invention is to provide an electro-cleaning, pickling and electroplating apparatus that uses a higher current density than conventional cleaning and plating apparatus.

Yet another object of the present invention is to provide an electro-cleaning and plating apparatus that is more rapid than the conventional process.

An additional object of the present invention is to provide an improved generally uniform cleaning, pickling and plating apparatus and process.

In addition to the various objects and advantages of the present invention described with some degree of specificity above it should be obvious that additional objects and advantages of the present invention will become more readily apparent to those persons who are skilled in the relevant art from the following more detailed description of the invention, particularly, when such description is taken in conjunction with the attached drawing figures and with the appended claims.

Figure 1:
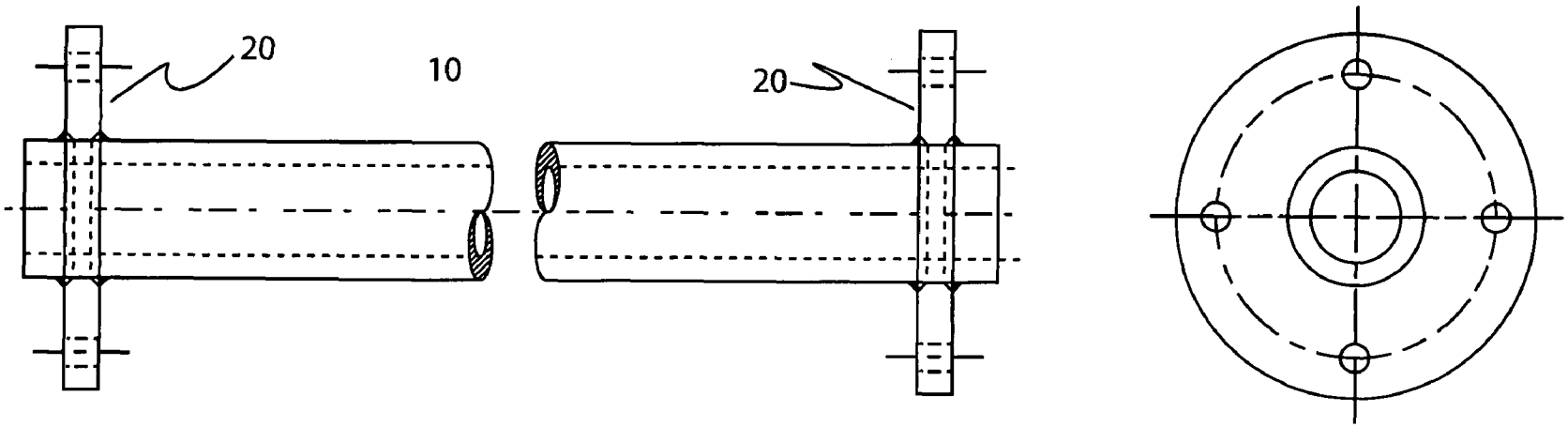
FIG. 1 is a truncated side elevational view of a length of tube along the longitudinal axis.

BRIEF DESCRIPTION OF A PRESENTLY PREFERRED AND VARIOUS ALTERNATIVE EMBODIMENTS OF THE INVENTION

Prior to proceeding to the more detailed description of the present invention it should be noted that, for the sake of clarity and understanding, identical components which have identical functions have been identified with identical reference numerals throughout the several views illustrated in the drawing figures.

Figure 2:
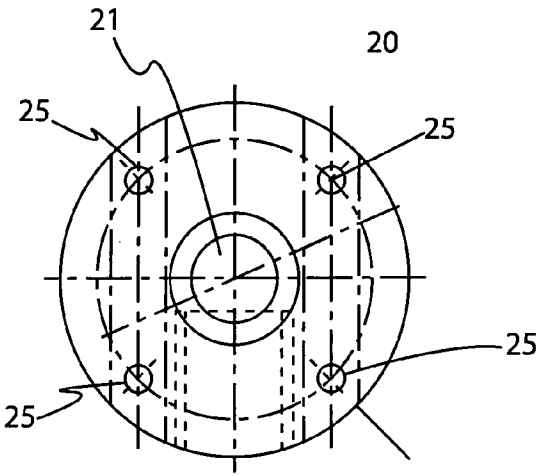
FIG. 2 is a front elevational plan view of the flange.
Figure 13:
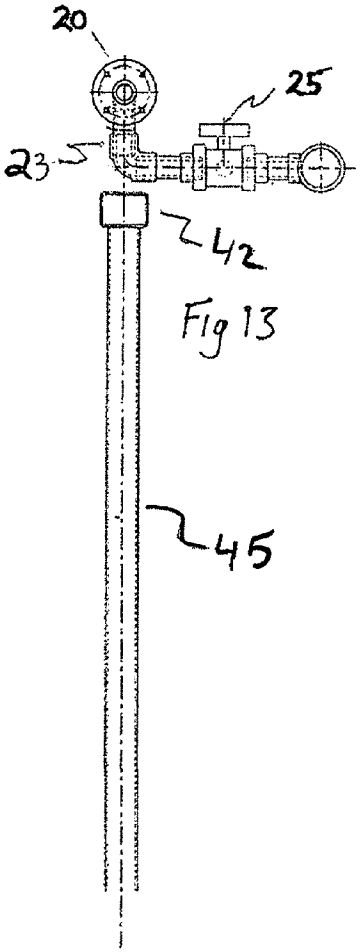
FIG. 13 is a front elevational plan view of support, supply tube and elongate tube.
Figure 12:
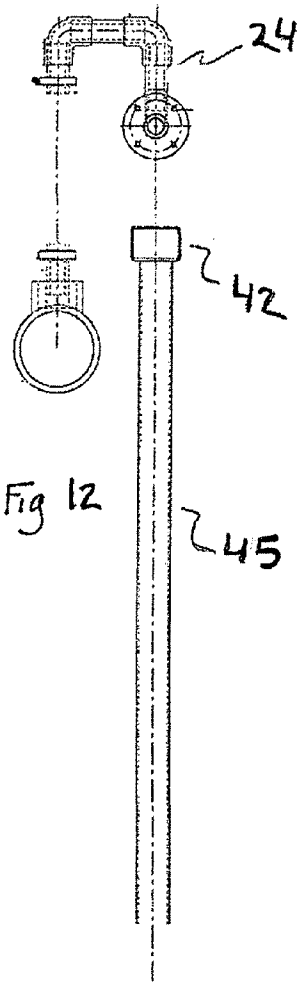
FIG. 12 is a front elevational plan view of support, return drain tube and elongate tube.
Figure 11:
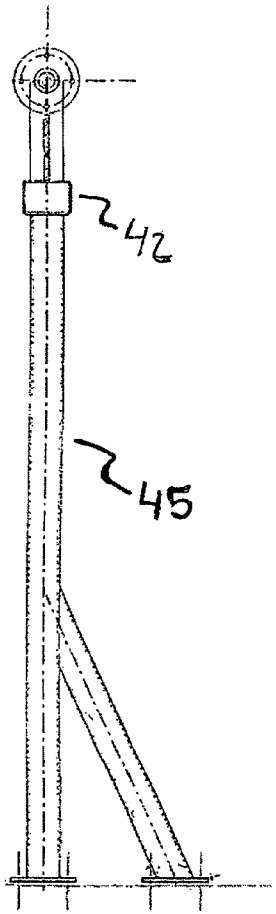
FIG. 11 is a front elevational plan view of support and tube.
Figure 15:
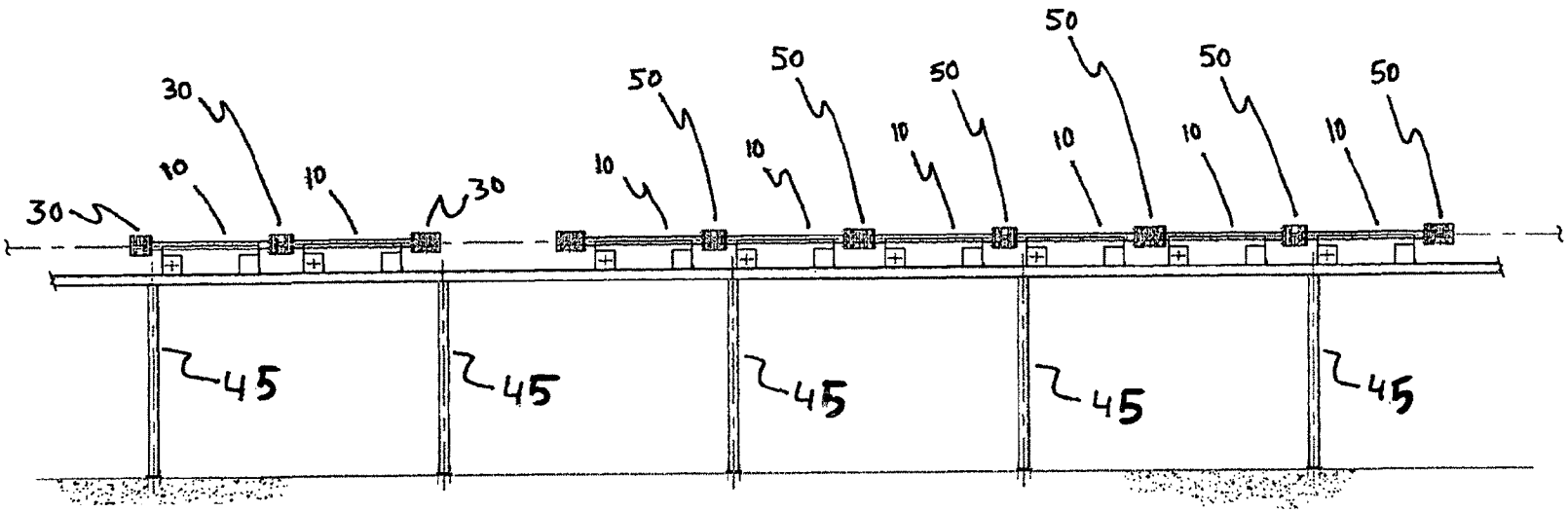
FIG. 15 is a partial side elevational view of the assembled electro-cleaning and electroplating apparatus.

Reference is now made, more particularly, to FIG. 1 and the elongate tube 10. The electro-cleaning, pickling portion of the apparatus has at least two elongate fluid impermeable tubes having end covers 20 attached generally adjacent to the first of the at least two elongate tubes 10 and a second cap 20 attached to the end of at least one elongate tubes. In the preferred embodiment the end cover is part of a flange as shown in FIG. 2. Each of the end covers has an aperture 21 slightly greater than the diameter of the wire. The preferred embodiment has a plurality of elongate tubes 10. Each of the elongate tubes has electrically conductive contacts 22 applying a current, including alternating polarities. Each of the elongate tubes has a feed tube 23 as shown in FIG. 13 and a drain tube 24 as shown in FIG. 12 in fluid communication with the elongate tube 10.

Figure 3:
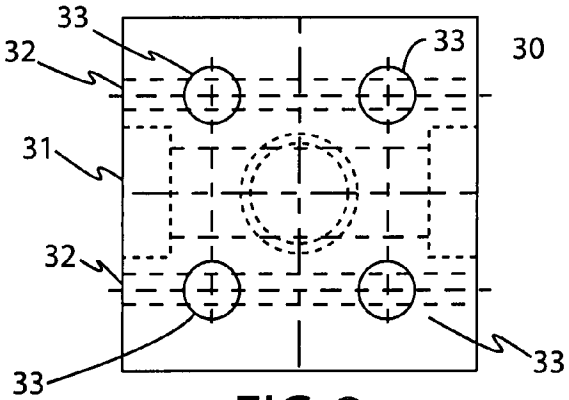
FIG. 3 is a top plan view of the connector in the cleaning and pickling portion of the apparatus.
Figure 4:
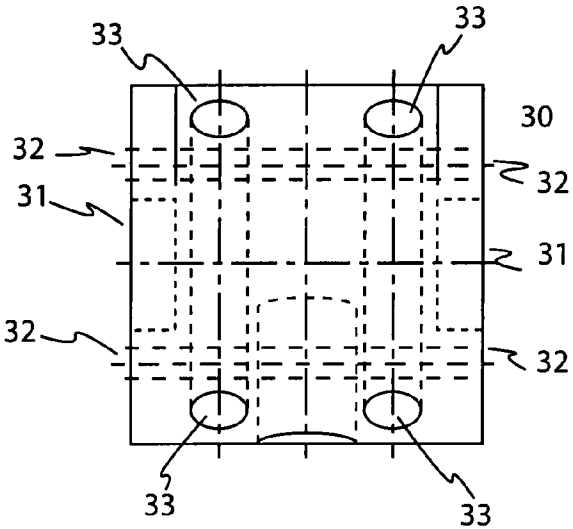
FIG. 4 is the front elevational plan view of the connector cleaning and pickling portion of the apparatus.
Figure 6:
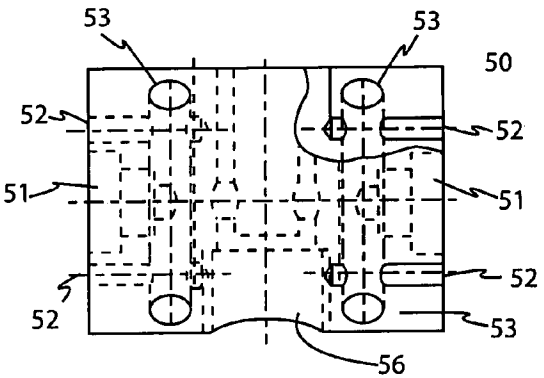
FIG. 6 is a partly in sectional front elevational view of the connector in the electroplating portion of the apparatus.
Figure 8:
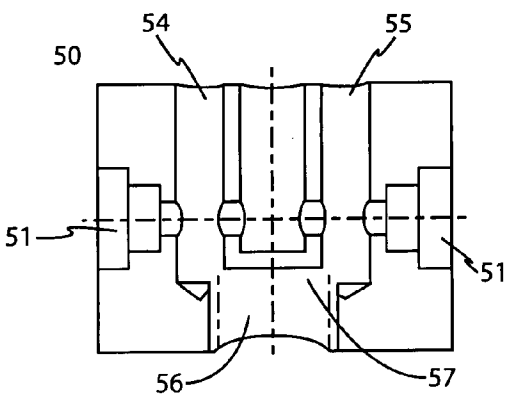
FIG. 8 is a sectional view of the connector in the electroplating portion of the apparatus along line A-A of FIG. 7.
Figure 5:
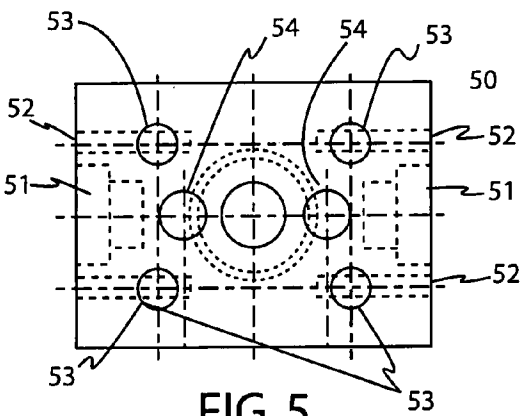
FIG. 5 is a top plan view of the connector in the electroplating portion of the apparatus.
Figure 7:
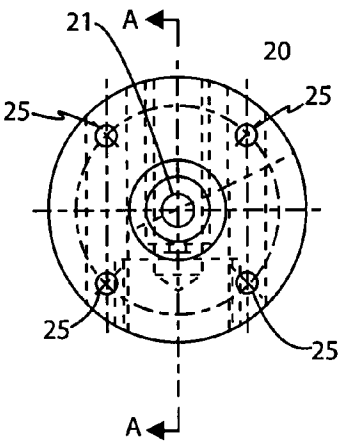
FIG. 7 is a front plan view of the flange in the assembled apparatus.

The plurality of elongate tubes are joined to a connecting member and the ends of the elongate tubes are connected to the connecting member by a connecting means. The connecting member 30 is shown in FIGS. 3 and 4. The connecting member 30 has an aperture 31 through the connecting member along the longitudinal axis. In the preferred embodiment the aperture at opposing surfaces of connecting member 30 have a diameter slightly larger than the outside diameter of elongate tubes 10. At predetermined depth, the diameter is reduced. The elevation of the aperture 31 is approximately the same as the center of the elongate tubes 10. The connecting member has apertures 32 along the longitudinal axis. In the preferred embodiment there are four apertures 32. The connecting member also has vertical apertures 33 aligned to intersect the longitudinal apertures 32.

Figure 9:
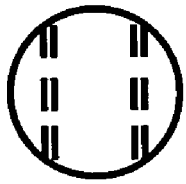
FIG. 9 is a top plan view of dowel.
Figure 10:
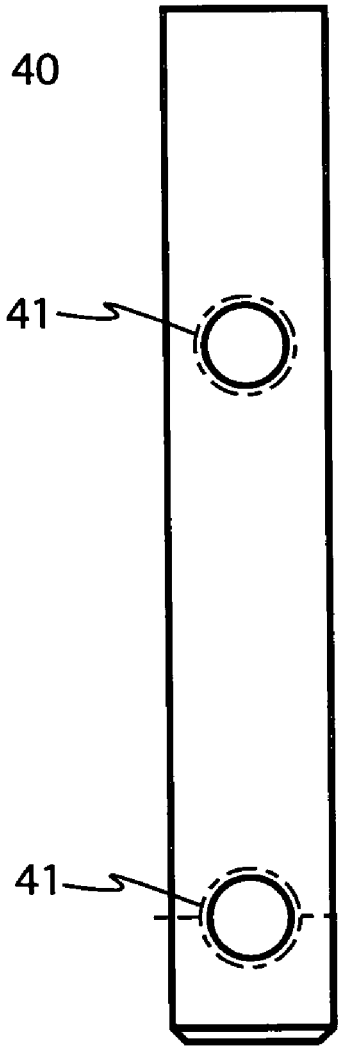
FIG. 10 is an elevational plan view of dowel.
Figure 14:
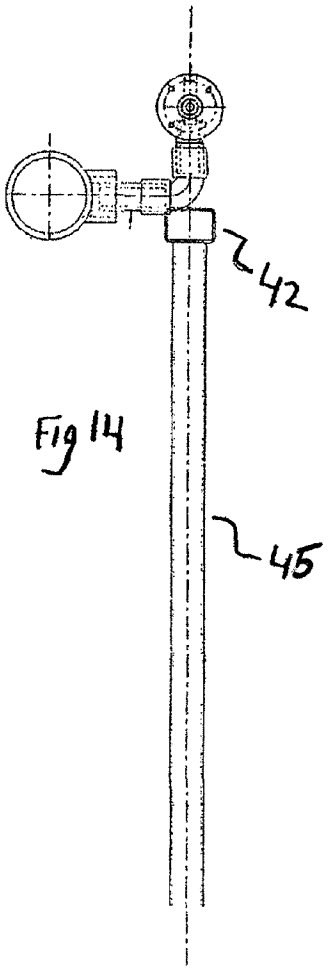
FIG. 14 is a front elevational plan view of drain, return tube and support.

The preferred embodiment has connecting means that includes is a flange 20 generally adjacent to each opposing end of the tubes to be connected. A pattern of flange apertures 25 is located at predetermined locations corresponding to an axially aligned with longitudinal connecting member apertures 32. FIG. 9 shows the partial plan view through the top surface of connecting member 30 showing the intersection with one of the longitudinal axis apertures 32. A dowel 40 shown in FIG. 10 has a pair of apertures 41 that are threaded and have predetermined diameter. The predetermined diameter accommodates a threaded bolt (not shown). The dowel 40 is inserted into vertical apertures 33 with the threaded apertures 41 generally aligned along the longitudinal axis of apertures 32. Bolts are inserted through the flange apertures 25 and are received by dowel apertures 41. The bolts are snugged connecting elongate tubes 10 to connecting member 30.

Another embodiment has a threaded male end of elongate tube 10 and a female threaded aperture 31. The female end of an elongate tube is receives by the male end the elongate tube to be connected. The tubes are then snugged together.

In the preferred embodiment, one or more banks of elongate tubes are connected axially along the longitudinal axis of the apparatus.

An appropriate solution used in conventional electro-cleaning, such as an alkaline salt, is continuously circulated in each tube. The flow is controlled by valve 25.

The wire to be cleaned is threaded through the aperture of the first elongate tube and exits through the aperture in the end cover of the last elongate tube. The wire can be rolled on to a take up reel or proceed to the plating portion of the apparatus.

The preferred embodiment as shown in FIGS. 11-15 has support members 45 to maintain the bank of a plurality of elongate tubes at an elevation. The preferred embodiment has an electrically non conductive material 42 such as a plastic between the elongate tube and the support member. Another embodiment is to include an electrically non conductive tube (not shown) with a diameter somewhat greater than the diameter of the elongate tubes. The elongate tubes 10 each have a feed tube 23 and a drainage tube 24 in fluid communication with each other.

The plating portion of the apparatus similarly has elongate tubes 20 with end covers 20 at each end. The apertures have a diameter slightly greater than the diameter of the wire to be electroplated. The preferred embodiment has a plurality of elongate tubes 10. The elongate tubes 10 are connected by a connecting member 50.

The connecting member 50 as shown in FIG. 5-8 has a first cavity 55 and a second cavity 55 in the top surface of the connecting member for electrodes. A third cavity 56 in the bottom surface of the connecting member is in fluid communication with the first 54 and second cavities 55. The connecting member 50 has a support portion 57 of with an elevation that is generally the center of the elongate tubes 10. The electrodes (not shown) are received in the first cavity 54 and the second cavity 55 on opposing sides of the support portion 57 press on the wire. The support member minimizes deflection of the wire and holds the wire in a generally straight line along the longitudinal axis of the apparatus. The electrodes in the electroplating portion are cathodes. A direct current is preferably applied to the electrodes.

The connecting member 50 has an aperture 51 through the connecting member along the longitudinal axis. In the preferred embodiment the aperture at opposing surfaces of connecting member 50 have a diameter slightly larger than the outside diameter of elongate tubes 10. At predetermined depth, the diameter is reduced. The elevation of the aperture 51 is approximately the same as the center of the elongate tubes 10.

The preferred embodiment connecting means for connecting the elongate tubes 10 to the connecting member 50 between said elongate tubes 10 is similar to the means described for the electro-cleaning and pickling portion of the apparatus. The elongate tubes 10 have a flange 20 generally adjacent to the opposing ends of tubes to be connected. In the preferred embodiment there are four apertures 52 in the connecting member. The connecting member also has vertical apertures 53 aligned to intersect the longitudinal apertures 52.

The preferred embodiment has connecting means that includes is a flange 20 generally adjacent to each opposing end of the tubes to be connected. A pattern of flange apertures 25 is located at predetermined locations corresponding to an axially aligned with longitudinal connecting member apertures 52. FIG. 9 shows the partial plan view through the top surface of connecting member 50 showing the intersection with one of the longitudinal axis apertures 52. A dowel 40 shown in FIG. 10 has a pair of apertures 41 that are threaded and have predetermined diameter. The predetermined diameter accommodates a threaded bolt (not shown). The dowel 40 is inserted into vertical apertures 33 with the threaded apertures 41 generally aligned along the longitudinal axis of apertures 52. Bolts are inserted through the flange apertures 25 and are received by dowel apertures 41. The bolts are snugged connecting elongate tubes 10 to connecting member 50.

Another embodiment has a threaded male end of elongate tube 10 and a female threaded aperture 51. The female end of an elongate tube is receives by the male end the elongate tube to be connected. The tubes are then snugged together.

In the preferred embodiment, one or more banks of elongate tubes are connected axially along the longitudinal axis of the apparatus.

An appropriate solution used in conventional electroplating, such as a metal salt, is continuously circulated in each tube. The flow is controlled by valve 25.

The wire to be electroplated is threaded through the aperture 21 of the first elongate tube 10 and exits through the aperture 21 in the end cover 20 of the last elongate tube 10. The wire can be rolled on to a take up reel.

The preferred embodiment as shown in FIGS. 11-15 has support members 45 to maintain the bank of a plurality of elongate tubes at an elevation. The preferred embodiment has an electrically non conductive material 42 such as a plastic between the elongate tube and the support member. Another embodiment is to include an electrically non conductive tube (not shown) with a diameter somewhat greater than the diameter of the elongate tubes. The elongate tubes 10 each have a feed tube 23 and a drainage tube 24 in fluid communication with each other.

The method to electro-clean and pickle is inserting the wire into the apparatus through an end cover aperture with a diameter slightly larger than the wire of an electrically conductive tube, circulating continuously an appropriate fluid through and electrically conductive elongate tube, applying a current, including alternating polarities, to the elongate tubes and removing the wire from the apparatus through a aperture in the end cover of the last elongate tube in a continuous process.

The method to electroplate is inserting the wire into the apparatus through an aperture in the end cover of and elongate tube; continuously circulating an appropriate fluid through the elongate tube, applying current to the electrodes in contact with the wire where the elongate tube is an anode and removing the wire from the apparatus through and aperture in the end cover of the elongate tube in a continuous process.

The apparatus and method to electro-clean and pickle and to electroplate can be used separately or in combination.

While a presently preferred and various alternative embodiments of the present invention have been described in sufficient detail above to enable a person skilled in the relevant art to make and use the same it should be obvious that various other adaptations and modifications can be envisioned by those persons skilled in such art without departing from either the spirit of the invention or the scope of the appended claims.

I claim:

1. An electro-cleaning and pickling apparatus for cleaning a continuous metal piece comprising:

at least two elongate tubes, each of said elongate tube is electrically conductive and is fluid impermeable, each of said elongate tube having a first end and a second end;

at least one electrically conductive contact for each of said elongate tubes, operably connected to said tube wherein said contact applies an alternating current to said tube;

a cover attached at each of said first end of said first of at least two elongate tubes and at said second end of the last of said at least two elongate tubes, each of said covers having an aperture with a predetermined size slightly larger than the diameter of such continuous metal piece;

a connecting means between said elongate tubes, said elongate tube where said metal piece enters said tubes having said end cover attached to said first end of said first elongate tube, said end cover having an aperture slightly larger than the continuous metal piece entering said plurality of elongate tubes, and said end cover at said second end of the last of said elongate tubes where said continuous metal piece exits said tubes, said end cover having an aperture slightly larger than said continuous metal piece exiting said tubes;

said connecting means further including:

a connecting member with a first aperture along the longitudinal axis of said elongate tubes at a predetermined position, a predetermined number of cavities at opposing sides of said connecting member along said longitudinal axis at predetermined positions and at least four apertures transverse to said longitudinal axis at predetermined positions;

at least four dowels each with at least two threaded apertures at predetermined positions received through said at least four transverse apertures;

a flange attached generally adjacent to each of each said ends of said connected elongate tubes having a predetermined number of flange apertures at a predetermined position in each of said flanges corresponding to said longitudinal cavities receiving bolts through said flange apertures, longitudinal cavities and dowel apertures, snugged to connect said elongate tubes;

a feed tube at a predetermined location and in fluid communication with each of said elongate tubes;

a drain tube at a predetermined location and in fluid communication with each of said elongate tubes; and a predetermined fluid circulating through each of said feed tube, said elongate tube and said drain tube.

2. An electro-cleaning and pickling apparatus according to claim 1 having a plurality of elongate tubes.

3. An electro-cleaning and pickling apparatus according to claim 1 wherein said flange in manufactured of carbon steel.

4. An electro-cleaning and pickling apparatus according to claim 1 wherein said predetermined number of flange apertures and connecting member cavities is between two and six.

5. An electro-cleaning and pickling apparatus according to claim 1 wherein said connecting means is threaded mating elongate tubes and connecting members.

6. An electro-cleaning and pickling apparatus according to claim 1 wherein said predetermined fluid is alkaline.

7. An electro-cleaning and pickling apparatus according to claim 1 wherein said predetermined fluid is a sulfate solution.

8. An electro-cleaning and pickling apparatus according to claim 1 further having a plurality of support members of a predetermined length generally adjacent to said elongate tubes at a predetermined spacing.

9. An electro-cleaning and pickling apparatus according to claim 1 further having a portion of said support members adjacent to said elongate tubes that is electrically non-conductive.

10. An electro-cleaning and pickling apparatus according to claim 1 further having an electrically non-conductive insulating tube having a generally greater inside diameter than the outside diameter of and surrounding said elongate tubes.

11. An electroplating apparatus for coating a continuous metal piece comprising:

at least one elongate tube, said elongate tube that is fluid impermeable, said at least one elongate tube having a first end and a second end;

an end cover for each said first end of said elongate tube and each said second end of said at least one elongate tube, each cover having an aperture with a predetermined size slightly larger than the diameter of said continuous metal piece to be coated, each of said covers attached to said at least one elongate tube, forming a fluid impermeable seal;

a connecting member having a top surface, bottom surface, opposing sides facing the longitudinal axis of said elongate tubes and opposing faces transverse to said elongate tubes, said connecting member is attached to said elongate tubes by a connecting means at the ends of said elongate tubes and said longitudinally facing sides of said connecting member, said connecting member having an aperture along the longitudinal axis, a first and second cavity through said top surface of said connecting member and a third cavity in said bottom surface of said connecting member;

said first and second cavities of said connecting member in fluid communication with said third cavity of said connecting member;

an anode received in said first cavity and a cathode received in said connecting member;

a drain tube attached to said connecting member in fluid communication with said third cavity;

a feed tube in fluid communication with said elongate tube;

said drain tube in fluid communication with said elongate tube; and a predetermined fluid circulating through said feed tube, said elongate tube and said drain tube.

12. An electroplating apparatus according to claim 11 wherein said connecting means and said connecting member further includes:

said connecting member having a first aperture along the longitudinal axis of said elongate tubes at a predetermined position, a predetermined number of cavities at opposing sides of said connecting member along said longitudinal axis at predetermined positions and at least four apertures transverse to said longitudinal axis at predetermined positions, at least four dowels each with at least two threaded aperture at a predetermined positions received through said at least four transverse apertures; and a flange attached generally adjacent to each of said ends of said connected elongate tubes having a predetermined number of flange apertures at a predetermined position in each of said flanges corresponding to said longitudinal cavities receiving bolts through said flange apertures, longitudinal cavities and dowel apertures, snugged to connect said elongate tubes.

13. An electroplating apparatus according to claim 11 wherein said anode is non-soluble.

14. An electroplating apparatus according to claim 11 wherein said predetermined fluid is acidic.

15. An electroplating apparatus according to claim 11 including a plurality of support members of predetermined length wherein said elongate tubes are supported at an elevation.

16. An electro-cleaning and electroplating apparatus for cleaning and coating a continuous metal piece comprising:

at least two elongate tubes, a first elongate tube and an at least second elongate tube, said elongate tubes are electrically conductive and are fluid impermeable, said at least two elongate tubes having a first end and a second end;

at least one electrically conductive contact for each of said at least two elongate tubes, operably connected to said tubes wherein said contact applies a current to said tubes;

a first end cover for said first end of said first elongate tube and a second end cover at said second end of said at least second elongate tube, each of said end covers having an aperture with a predetermined size slightly larger than the diameter of said continuous metal piece, said first end covers attached to said first end of said first elongate tube and said second end of said at least second elongate tube;

a first electrically non-conductive connecting member between each of said at least two elongate tubes to be connected wherein said connecting member is connected to the respective ends of said at least two elongate tubes to be connected by a connecting generally adjacent to said ends of said at least two elongate tubes and the connecting member;

a feed tube in fluid communication with each of said at least two elongate tubes;

a drain tube in fluid communication with each of said at least two elongate tubes;

a predetermined fluid circulating through said feed tube, each of said at least two elongate tubes and said drain tube;

at least another one elongate tube, said elongate tube that is fluid impermeable, said at least another one elongate tube having a first end and a second end;

another end cover for each of said first end of said at least another one elongate tube and each of said second end of said at least another one elongate tube, each of said another end covers having an aperture with a predetermined size slightly larger than the diameter of said continuous metal piece to be coated, each of said another end covers attached to said at least another one elongate tube, forming a fluid impermeable seal;

a second electrically non-conductive connecting member having a first side and a second side along the longitudinal axis of said at least another one elongate tube, a third and fourth side transverse to said longitudinal axis, a top and bottom, said second connecting member is attached at said third and fourth sides to said ends of said at least another one elongate tube by a connecting means, with said connecting means between said at least another one elongate tube, said connecting means having an aperture through said connecting means along the longitudinal axis with a diameter slightly larger than said metal piece, a first cavity and a second cavity through said top of said connecting member and a third cavity through said bottom surface; generally along a vertical axis;

said first and second cavities of said second connecting member in fluid communication with said third cavity of said second connecting member;

an electrode received in said first cavity and another electrode received in said second cavity of said second connecting member;

another drain tube attached to said second connecting member in fluid communication with said third cavity;

another feed tube in fluid communication with said at least another one elongate tube;

another drain tube in fluid communication with said at least another one elongate tube; and another predetermined fluid circulating through each of said another feed tube, said at least another one elongate tube and said another drain tube.

17. An electro-cleaning and electroplating apparatus according to claim 16 wherein said connecting means has at least four dowels each with at least two threaded apertures at predetermined positions received through said at least four transverse apertures; and a flange attached generally adjacent to each of said ends of said connected at least another one elongate tube having a predetermined number of flange apertures at a predetermined position in each of said flanges corresponding to longitudinal cavities receiving bolts through said flange apertures, said longitudinal cavities and said dowel apertures, snugged to connect said at least another one elongate tube.

18. An electro-cleaning and electroplating apparatus according to claim 16 wherein said connecting means is threaded mating said at least another one elongate tube and connecting members.

19. An electro-cleaning and electroplating apparatus according to claim 16 further having a plurality of support members of a predetermined length generally adjacent to said at least two elongate tubes and said at least another one elongate tube at a predetermined spacing.

20. An electro-cleaning and electroplating apparatus according to claim 19 further having a portion of said support members adjacent to said at least two elongate tubes and said at least another one elongate tube that is electrically non-conductive.

* * * * *